United States Patent [19]

Learnahan

[11] Patent Number: 4,627,180

[45] Date of Patent: Dec. 9, 1986

[54] EXCAVATING BUCKET

[76] Inventor: Harold Learnahan, 4206 W. Melrose, Chicago, Ill. 60641

[21] Appl. No.: 570,778

[22] Filed: Jan. 16, 1984

[51] Int. Cl.[4] ..... B66C 3/02

[52] U.S. Cl. ..... 37/184; 175/242; 175/292

[58] Field of Search ..... 37/1, 183, 184; 172/21, 172/22; 175/238, 241, 242, 292

[56] References Cited

U.S. PATENT DOCUMENTS

| | | | |
|---|---|---|---|
| 904,680 | 11/1908 | Burrows | 175/238 X |
| 2,499,508 | 3/1950 | Karhu | 175/238 X |
| 3,185,226 | 5/1965 | Robbins | 37/1 X |
| 3,497,021 | 2/1970 | Burrell | 175/238 |
| 3,621,923 | 11/1971 | Allard | 175/242 X |
| 4,106,225 | 8/1978 | Schnabel, Jr. | 37/184 |

FOREIGN PATENT DOCUMENTS

| | | | |
|---|---|---|---|
| 37113 | 7/1914 | Sweden | 37/1 |

*Primary Examiner*—Edgar S. Burr
*Assistant Examiner*—Moshe I. Cohen
*Attorney, Agent, or Firm*—Neuman, Williams Anderson & Olson

[57] ABSTRACT

An open ended cylindrical casing is provided with a pair of semicircular blades rotatably mounted to the lower open end of the casing so that the blades may be rotated from a digging position where they project downward from the lower end of the casing to a flat position, substantially forming a bottom to the lower end of the casing. To excavate a cylindrical hole the casing is dropped with the blades in the projecting position into the ground causing the blades to dig in a shovel-like manner. By rotating the blades upward substrate is lifted into the casing, and the casing is pulled deeper into the substrate. Lifting the casing out of the hole, the blades act as a bottom to the casing carrying dirt within the casing.

8 Claims, 4 Drawing Figures

EXCAVATING BUCKET

BACKGROUND OF THE INVENTION

1. Field of the Invention

The present invention relates generally to the excavation of cylindrical holes for pilings and other vertical supports and has particular reference to an improved cable supported blade and casing arrangement adapted to excavating a cylindrical hole without the use of cumbersome drilling elements.

2. Background of the Invention

To adequately support a heavy structure on unstable ground, it is frequently necessary to provide piles or other supports between the base of the structure and a more stable stratum well below the base. These supports may consist of steel or timber driven into the ground. Often, however, they consist of reinforced concrete formed in place in a hole that has been excavated to the desired depth.

Typically, the hole is bored into the ground by a large auger, known as a Kelly bar, which must be supported and maneuvered by a machine able to both rotate the Kelly bar about its longitudinal axis and lift the Kelly bar from the hole to clear dirt and other debris. Since a Kelly bar may be fifty feet long, it is usually hung from a crane and fitted to a rotational drive mechanism mounted to the derrick of the crane.

The depth to which a hole may be bored by this method is limited to the length of the Kelly bar used. Should it be necessary to bore a deeper hole than initially anticipated this may require the use of a second, longer Kelly bar.

It is therefore an object of this invention to provide an improved excavation means to overcome or substantially reduce the aforementioned problems associated with auger conveyor excavation.

More specifically it is an object of this invention to provide a bucket-type excavation device which does not require rotational drive means.

A further specific object of this invention is to provide an easily operable excavating device whose digging blades also serve as the bottom to the bucket-like device.

Other and further objects of this invention will become apparent to those skilled in this art from the detailed description of a preferred embodiment of the apparatus for use in accordance with the present invention.

SUMMARY OF THE INVENTION

According to this invention, a cylindrical casing, open on each end, is equipped with a blade assembly adapted for excavating cylindrical holes. The cylindrical casing is equipped with a pair of holes located at the lower end of the casing, situated diametrically opposite each other. These holes may be drilled throught the lower end of the casing, or may be located on small protruberances extending from the lower end of the casing. With the use of an elongated pin extending through these holes a blade assembly is attached to the casing. The width of the casing is tapered at the lower end providing a sharp edge at the bottom of the bucket-like casing.

The blade assembly consists of two blades preferably of semicircular shape. Each of the semicircular blades is tapered such that the arcuate edge forms a narrow cutting part of the blades. Each of the blades is thicker along the non-arcuate, or diametric edge forming a bulkhead part to each blade. Extending from the diametric edge of each blade is a set of knuckles, each arranged to compliment the set of knuckles on the other blade. The two blades may thereby be joined so that each set of knuckles nests between those of the other blade. Through each knuckle there is a hole situated such that when the two blades are joined together the holes will be aligned to form a channel through all of the knuckles. The blades are rotatably attached to the casing by a hinging means in the form of the elongated pin placed through the diametrically opposed holes in the casing and the channel formed by the holes in the knuckles.

In an alternative embodiment of the invention each blade may be attached to the casing by separate hinging means. Two pairs of holes are situated through the lower end of the casing, one pair associated with each blade. Through each blade a single channel is disposed parallel to the diametric edge through the bulkhead part of the blade. Two elongated pins are then used, each rotatably fixing one of the blades to one of the pairs of holes in the casing.

In operation the blades will each rotate through a path of approximately 90° from a first, or digging position where the blades project downward generally perpendicular to the plane of the lower open end of the casing, to a second position where the blades are generally parallel to the plane of the lower open end. In the second position the blades substantially form a closed surface, or bottom to the lower open end.

When the apparatus is dropped into a hole with the blades in the digging position the blades will penetrate the substrate at the bottom of the hole. As the blades are caused to rotate from this first position to the second position the blades will push against this substrate. This will not only cause the substrate to be lifted to the interior of the bucket-like casing, but the force exerted by the blades against the substrate will act to pull the casing deeper into the hole. The sharpened lower end of the casing facilitates the "digging" of the casing deeper into the hole.

A means to rotate the blades about the hinging means in associated with either of the above-described blade assemblies. In one such means a projection is attached to the bulkhead part of each blade. The projections should be situated at an angle not greater than 90° with respect to the blade surface, so that the projections will not obstruct the approximate 90° rotation of the blades. Also, the length of the projections must be no greater than the internal radius of the casing, so that the projection will not be obstructed by the casing during its rotation. The projections may have any of a variety of shapes.

A rigid arm is rotatably attached to the end of each of these projections. These arms are each rotatably attached at the other end to a mounting block disposed centrally in the casing. When the mounting block is raised within the casing, the rigid arms in turn move upward causing the projections to move centrally. This effectuates a movement of the blades from a first position where the blades project downward from the lower open end and are generally perpendicular to the plane of the opening at the lower open end to a second position where the blades are generally parallel to the plane of the lower open end and substantially form a flat, closed surface to the lower open end.

Another means to rotate the blades about the hinging means makes use of a cable assembly in place of the rigid arms and mounting block. In this arrangement a rigid tubular member is mounted centrally within the cylindrical casing and projecting through the upper open end. The cable assembly itself is fixedly attached to the projection from one of the blades. The cable is then moveably attached to the projection from the other blade, such as by threading through an eyelet on the projection. The cable is then threaded through the rigid tubular member. The pulling of this cable upward will cause the projections to move centrally, which in turn effectuates a movement of the blades from the first to the second position.

The device is also equipped with a means to raise and lower the device from a hole. One such means may employ a second cable which runs through the centrally mounted rigid tubular member. The cable is fixed to a wedge or a brace which cannot fit within the tubular member. The pulling of this second cable forces the wedge or brace against the bottom of the rigid tubular member, which in turn will lift the device from the hole.

The attachment of this bucket-like device to a cable means for raising and lowering the device permits the digging of a hole of any depth limited only by the length of the cable. This versatility provides a particular advantage of the present device over a Kelly bar, which is inherently limited to digging holes no greater than its own length.

DETAILED DESCRIPTION OF A PREFERRED EMBODIMENT

Figure 1:
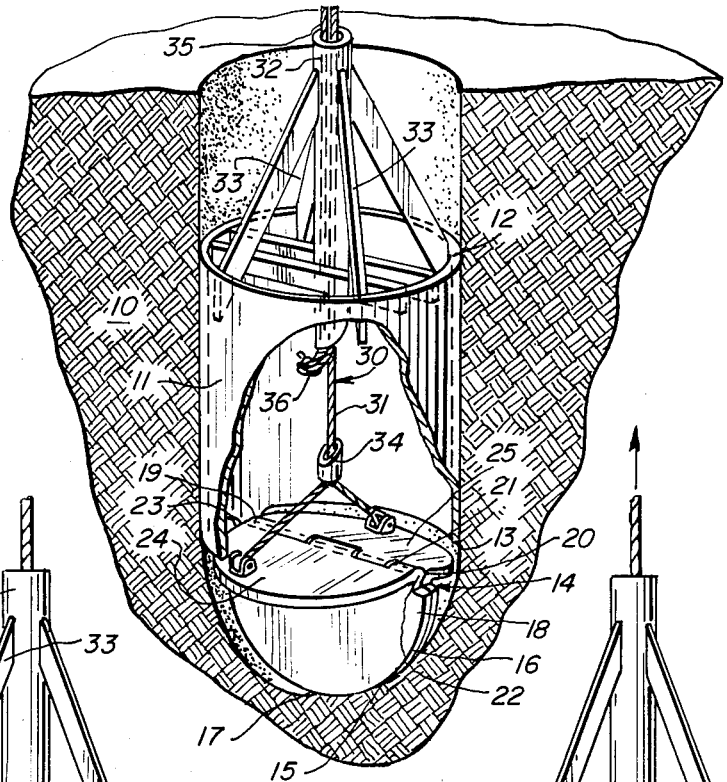
FIG. 1 is a cut away perspective view of the excavating device with a cable assembly with the blades in a first position.

As seen in FIG. 1 a cylindrical excavating device 10 is comprised of a cylindrical casing 11, having an upper open end 12 and a lower open end 13. The casing is tapered toward the lower open end to facilitate digging into the ground. The device is equipped with a blade assembly 14 disposed at the lower open end of the casing.

The blade assembly consists of two blades 15, 16. Each blade consists of a cutting part 17 and a bulkhead part 18. The blades are preferably of a semicircular shape and are tapered toward the cutting part of the blade. The bulkhead part terminates along the diametric edge 19 of the semicircular shape.

FIG. 1 illustrates the blades in a first position where the blades project downward from the lower open end of the casing. When in this position the first surface of each blade 15, 16 faces outward from each other. The second surface of each blade in turn faces inward toward the other blade.

The blade assembly is rotatably attached to the casing at the lower open end by a hinging means 20. The hinging means illustrated in FIG. 1 consists of a plurality of knuckles 21 disposed along the diametric edge of each blade. The respective set of knuckles of each blade are of complimentary shape so that the knuckles of one blade will nest between a space defined between two adjacent knuckles of the other blade. Through each knuckle there is a hole position so that when the knuckles are nested between each other the holes align to form a channel through all of the knuckles. An elongated pin 22 is disposed within this channel and provides a means about which the blades may rotate.

The elongated pin attaches the blade assembly 14 to the casing through a pair of diametrically opposed holes at the lower open end of the casing. These holes may be through the casing itself or illustrated through a pair of protruberances (one shown as 23) extending from the lower open end of the cylindrical casing.

A means to rotate the blades about the hinging means is illustrated in FIG. 1 as a pair of semicircular projections 24, 25 one attached to each blade. These projections are attached to each blade along the diametric edge 19 of the bulkhead part 18. The length of the radius of each of these semicircular projections should be less than the internal radius of cylindrical casing 11, thereby allowing free rotation of the projections within the casing.

In the path of its rotation the blades 15, 16 will rotate approximately 90°, from a first position where the blades project downward to a second position where the blades are substantially parallel to the plane of the lower open end of the casing. This path can best be seen in FIGS. 2, 3 and 4. In order to allow free rotation in this path, the angle formed by each projection and the blade to which it is attached should be no greater than 90°.

Figure 2:
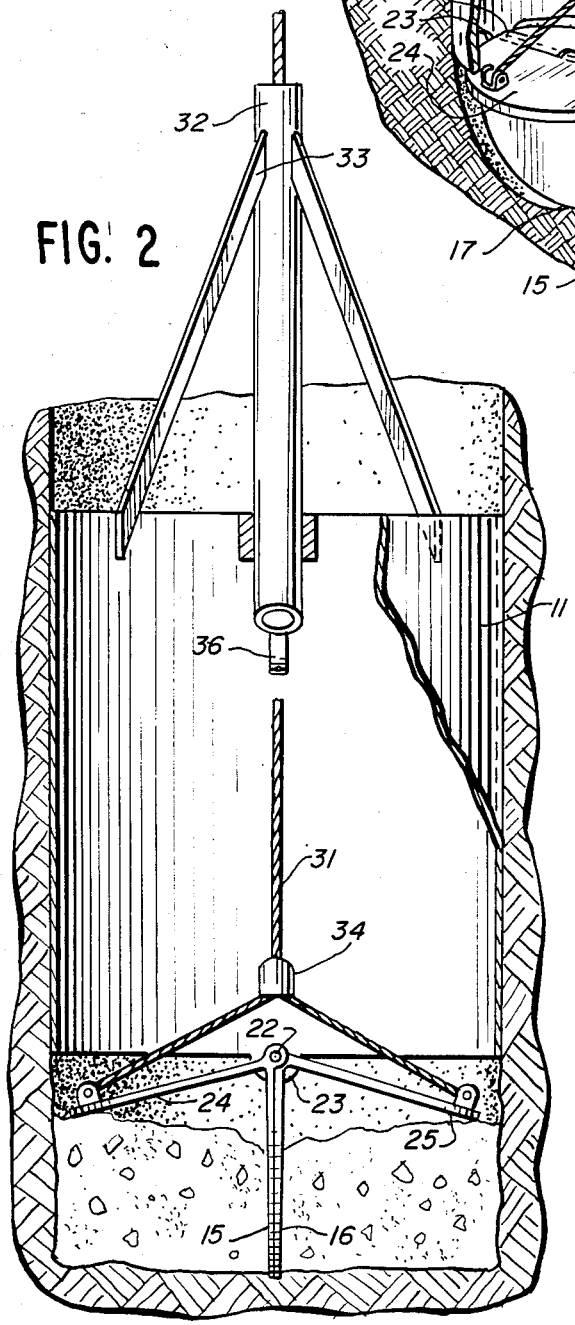
FIG. 2 is a cut away side view of the excavating device with a cable assembly with the blades in a first position.
Figure 3:
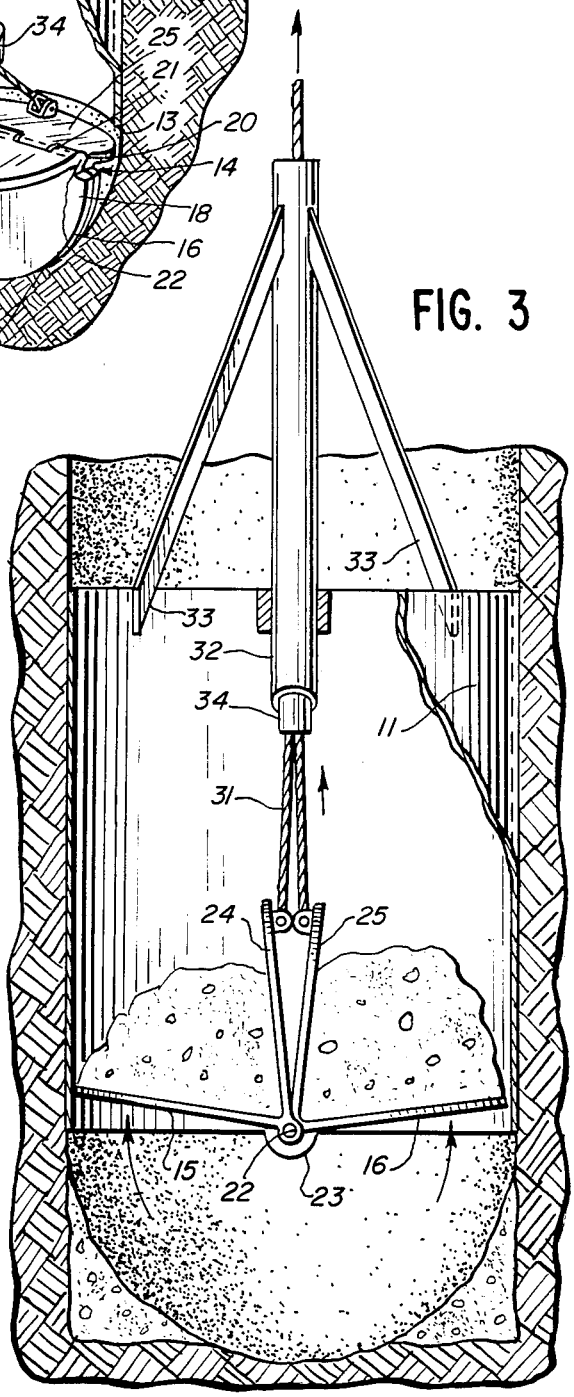
FIG. 3 is a cut away side view of the excavating device with a cable assembly with the blades in a second position.

To each projection is attached a means which effects the rotation. In FIGS. 2 and 3 is illustrated a cable assembly 30 for this purpose. A cable 31 is fixedly attached to projection 25. The cable is then moveably attached to projection 24, such as by threading through an eyelet or a pair of holes in projection 24. The cable is then threaded through a centrally braced rigid tubular member 32. This rigid tubular member is held in place and secured to the casing by a plurality of bracing members 33. An optional cable joining member 34 is attached to the cable so that it will contact the bottom of rigid tubular member 32 when the blades have rotated to the second position (illustrated in FIG. 3). The optional cable joining member should be of a configuration which will brace against the bottom of the rigid tubular member and will not fit within the inner diameter. Also threaded through the rigid tubular member is a lifting cable 35. This cable is fixed to a cable bracing member 36 extending from the bottom of rigid tubular member 32. Upward force on lifting cable 35 will cause the entire excavating device to be hoisted upwards.

Figure 4:
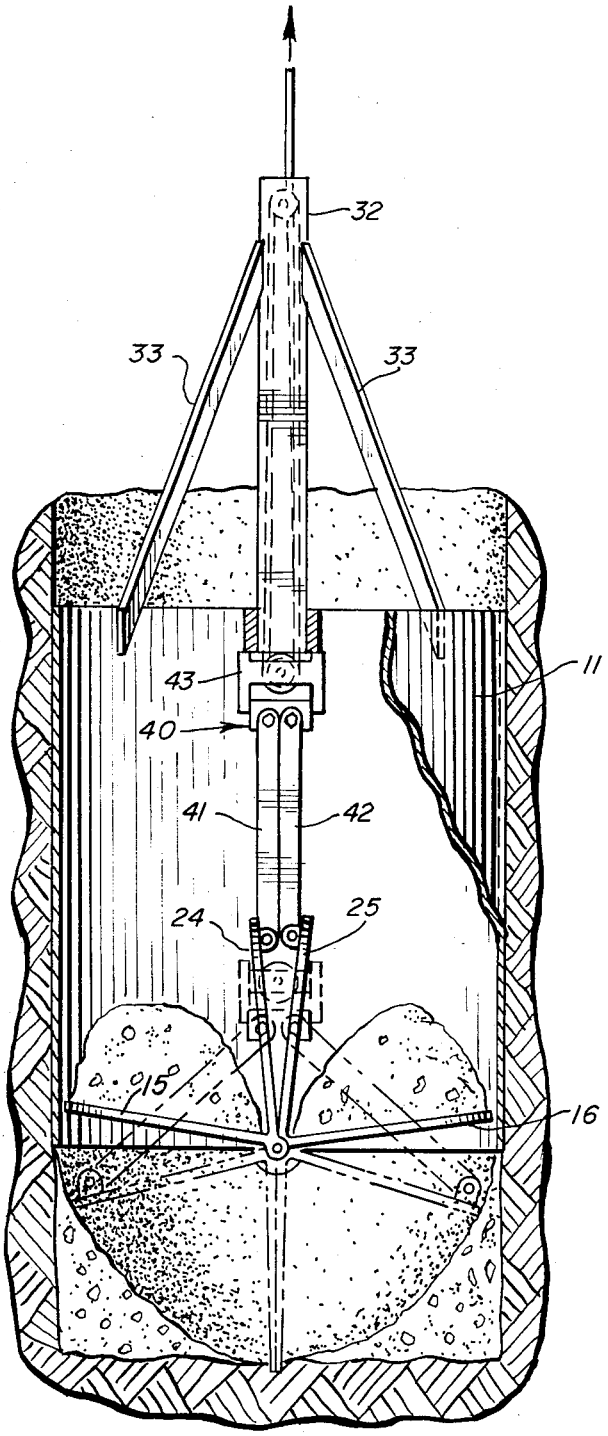
FIG. 4 is a cut away side view of the excavating device with a rigid arm assembly showing the movement of the blades from a first to a second position.

An alternative embodiment is illustrated in FIG. 4 wherein cable assembly 30 has been replaced by rigid arm assembly 40. Rigid arms 41, 42 are rotatably attached, one to the projection of each blade. The other end of each rigid arm is attached to a mounting block 43, disposed centrally in the cylindrical casing. When the mounting block is caused to rise, the rigid arms rise and move centrally to substantially parallel vertical alignment. This, in turn, causes the blade assembly to rotate from a first position where the blades project downward to a second position where the blades substantially form a flat, closed surface to the lower open end.

In operation the device is dropped, with the blades in the digging position, into the the ground. The force of the falling device, which may weigh more than a thousand pounds for a thirty inch diameter casing, will cause the blades to penetrate the substrate. As the blades are then rotated upward they may lift loose substrate holding it inside the bucket-like casing. With harder substrates, the lifting of the blades will meet greater resistance. The effect of this resistance will be to pull the casing deeper into the hole. The tapered lower end of the casing makes it easier for it to penetrate the substrate. When the blades are in the second position the device may be hoisted from the hole carrying a quantity of the substrate within the bucket-like device.

The invention has been described in detail with particular reference to a preferred embodiment. It is thought that the invention and many of its attendant advantages will be understood from the foregoing and it will be apparent that various changes may be made in form, construction and arrangement thereof without departing from the scope and spirit of the invention.

What I claim is:

1. An excavating device comprising:

a generally cylindrical casing having both an upper and a lower open end, each generally lying in a plane perpendicular to the axis of the casing, said casing at said lower open end being generally tapered;

a blade assembly including hinging means rotatably mounted along the diameter of said casing at the lower open end of the casing, said assembly including a first and a second blade, each of said blades having a cutting part and a bulkhead part and a first and second surface means to simultaneously rotate said blades in opposite directions about said hinging means from a lower position in which said blade assembly extends downwardly generally perpendicular to the plane of said lower open end with said second surfaces juxtaposed and the bottom of said casing is open, to and from an upper position in which said blade assembly forms a substantially flat plane substantially closing the bottom of said casing and the first surface of each blade faces inward from the lower end of said casing, and the second surface of each blade faces outward from the lower end of said casing.

2. The excavating device as defined in claim 1 wherein each blade comprises a semicircular shape, said cutting part on each blade defines a substantially arcuate edge, and said bulkhead part terminates along a generally diametric edge of said semicircular shape.

3. The excavating device as defined in claim 2, wherein said hinging means comprises a plurality of knuckles disposed and arranged along said diametric edge of each blade so that each knuckle will nest between a space defined between two adjacent knuckles of each other blade, the width of each knuckle being approximately equal to the space defined by the two adjacent knuckles of the other blade between which said knuckle will nest, each of said knuckles having a hole parallel to the diametric edge of each blade, disposed such that said holes will be aligned to form a channel through all of said knuckles when said blades are nestingly joined, said channel aligned with said diametrically opposed holes in the casing, and an elongated pin disposed within said diametrically opposed holes and said channel.

4. The excavating device of claim 1 wherein the cutting part on each blade is tapered.

5. The excavating device as defined in claim 1 wherein said means for rotating said blades in opposite directions comprises a pair of projections, one extending from the first surface of each of said blades along the diametric edge at an angle not greater than 90° and each of said projections having a length less than the internal radius of the cylindrical casing and a pair of rigid arms, associated with said pair of projections such that one of said rigid arms is rotatably attached at one end to one of said projections and the other of said rigid arms is rotatably attached at one end to the other of said projections, a mounting block located within the cylindrical casing, to which each of said rigid arms is rotatably attached such that the raising of the mounting block will effectuate rotation in opposite directions of each of said blades, and a means for raising the mounting block.

6. The excavating devices as defined in claim 1 wherein said means for rotating said blades in opposite directions comprises a pair of projections, one extending from the first surface of each of said blades along the diametric edge at an angle not greater than 90° and each of said projections having a length less than the internal radius of the cylindrical casing, a rigid tubular member mounted centrally within the cylindrical casing, projecting through the upper open end, and a cable assembly wherein a cable is fixedly attached to the projection extending from one blade and is moveably attached to the projection extending from the other blade and is threaded through said rigid tubular member such that the movement of said cable upward through said rigid tube causes said projections to move towards each other effecting a rotational movement in each of said blades.

7. The excavating device of claim 5 wherein the first and second projections each comprise a semicircular plate.

8. The excavating device as defined in claim 1 wherein said diametrically opposed holes are located on diametrically opposed protruberances extending from the lower open end of said cylindrical casing.

* * * * *